US006942604B2

(12) United States Patent
Teff

(10) Patent No.: US 6,942,604 B2
(45) Date of Patent: Sep. 13, 2005

(54) EXERCISE BOARD WITH ELASTIC FOOT STRAP

(76) Inventor: Joseph J Teff, 1336 Stratford Ct., Middleton, WI (US) 53562

( * ) Notice: Subject to any disclaimer, the term of this patent is extended or adjusted under 35 U.S.C. 154(b) by 525 days.

(21) Appl. No.: 10/192,829

(22) Filed: Jul. 10, 2002

(65) Prior Publication Data

US 2004/0009850 A1 Jan. 15, 2004

(51) Int. Cl.[7] ..... A63B 23/08; A63B 22/16
(52) U.S. Cl. ..... 482/79; 482/146
(58) Field of Search ..... 482/79–80, 145–146, 482/51; 601/27–28, 24–25

(56) References Cited

U.S. PATENT DOCUMENTS

| | | | | | |
|---|---|---|---|---|---|
| 1,801,769 | A | * | 4/1931 | Gartner | 602/2 |
| 1,981,379 | A | | 11/1934 | Thomson et al. | |
| 2,941,801 | A | | 6/1960 | Pedersen | |
| 3,361,427 | A | * | 1/1968 | Paves | 482/146 |
| 3,438,626 | A | * | 4/1969 | Modla | 482/146 |
| 3,471,144 | A | | 10/1969 | Dreux-Boucard | |
| D227,584 | S | | 7/1973 | Perez | |
| 3,967,820 | A | | 7/1976 | Harper | |
| 3,984,100 | A | | 10/1976 | Firster | |
| 4,206,558 | A | * | 6/1980 | Bivona | 36/7.5 |
| 4,371,162 | A | * | 2/1983 | Hartzell | 482/123 |
| 4,679,550 | A | | 7/1987 | Quam et al. | |
| D298,266 | S | | 10/1988 | Reyneke | |
| D319,094 | S | | 8/1991 | Bush | |
| 5,048,823 | A | | 9/1991 | Bean | |
| 5,203,279 | A | | 4/1993 | Eversdyk | |
| 5,284,465 | A | | 2/1994 | Homan, Jr. | |
| 5,584,787 | A | | 12/1996 | Guidry | |
| 5,643,154 | A | | 7/1997 | Teff | |
| 5,643,164 | A | * | 7/1997 | Teff | 482/146 |
| 5,645,516 | A | * | 7/1997 | Foster | 482/79 |
| D385,318 | S | | 10/1997 | Videtto | |
| 5,802,743 | A | * | 9/1998 | Chien | 36/141 |
| 5,897,474 | A | * | 4/1999 | Romero | 482/146 |
| D420,407 | S | | 2/2000 | Garcia et al. | |
| 6,042,521 | A | | 3/2000 | De Giorgis | |
| 6,063,013 | A | * | 5/2000 | Vathappallil | 482/121 |
| 6,315,695 | B1 | | 11/2001 | Follett et al. | |
| 6,666,797 | B1 | * | 12/2003 | Martin | 482/51 |

OTHER PUBLICATIONS

"New Rock & Roller™ Exercise Board Helps Improve Patient Balance And Strength" Success Express, vol. 18, No. 2, p. 9.

* cited by examiner

*Primary Examiner*—Stephen R. Crow
*Assistant Examiner*—Fenn C. Mathew
(74) *Attorney, Agent, or Firm*—Stiennon & Stiennon

(57) ABSTRACT

A generally rectangular exercise board with curved ends has an upper planer support surface. Beneath the support surface, are two projecting spaced parallel arcuate rockers. Each rocker has a flat portion adjacent to one long edge of the rocker board. The flat sections makes an angle of approximately 45° with the planar surface of the board. A hemispherical projection is formed between the two rockers. A band of rubber is fastened to the board between the rockers which is arranged to accommodate a foot placed between the band of rubber and the bottom surface of the board so the front portion of the foot is elastically biased against the board and exercises can be performed by moving the foot away from the board to induce elastic strain in the band of rubber.

6 Claims, 5 Drawing Sheets

EXERCISE BOARD WITH ELASTIC FOOT STRAP

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to exercise equipment in general and to rocking exercise boards in particular.

Strength and flexibility of the lower body are important to everyone. Strength and flexibility in the feet, ankles, knees, thighs and hips can reduce the possibility of injury or strain from engaging in various sporting activities. On the other hand, to those who have suffered an injury to the lower extremities, a program of exercise which both strengthens and improves joint mobility can be critical in recovering full use of the extremities and in preventing recurrence of ankle, knee and joint strains and injuries.

Those involved in sporting activities, for example skiing, biking, roller blading, ice skating, etc., have long known of the benefits of warmup and other stretching exercises to reduce the possibility of injury by imparting greater strength and mobility, particularly with respect to the lower extremities of the body.

Tendons, the connective structures of the body, link together the various bones and joints within the body. Muscles provide the motive power for the joints. Muscles can be strengthened by exercise and tendons can be lengthened by repeated stretching. Greater muscular strength allows the body to resist excessive motion between bodily joints. Increased flexibility or tendon length allows a greater range of movement of the joints before damage is sustained by the body.

A full range of motion of the joints of the lower extremities is extremely important to mobility which, in turn, has a major impact on the quality of life. For those who have suffered injuries which interfere with mobility there is a very real need to recover the mobility. Such recovery of mobility can often be achieved through exercise which builds joint strength and flexibility.

One exercise device which is known for exercising the lower extremities consists of a board supported on two rockers. The exercise is performed by standing on the board while grasping a stationary object and rocking back and forth on the board. Thus, the upper portion of the body is held substantially vertical while the lower portion of the body conforms to the inclined surface produced by the board rocking back and forth. The orientation of the body with respect to the direction of rocking may be varied so the joints of the lower extremities receive a full range of motion.

Existing boards with rockers, such as shown in my U.S. Pat. No. 5,643,164, the disclosure of which is incorporated herein by reference, are designed to increase the range of motion of joints. The board shown in my prior patent illustrates a means whereby the maximum extension of the joints may be approached gradually and the joint held in that position of maximum extension for a period of time. However, an exercise board which provides a wider range of exercises is desirable.

What is needed is an exercise board which can be used to perform a wider range of exercises.

SUMMARY OF THE INVENTION

The exercise board of this invention has an upper planer support surface of roughly rectangular shape where the short sides of the rectangle have been replaced by convex arcs. Opposite the upper planer support surface, are two spaced apart parallel arcuate rockers which are perpendicular to the long sides of the rectangle and extend outwardly of the board. Each rocker has a flat portion adjacent to one long edge of the rocker board. The flat sections make an angle of approximately 45° with the planar surface of the board. Between the two rockers, on the side of the board opposite that on which a person using the board stands, a hemispherical pedestal or projection is formed. A band of rubber is also fastened to the board between the rockers. The band of rubber is arranged to accommodate a foot placed between the band of rubber and the bottom surface of the board so the front portion of the foot is retained between the band of rubber and the board. The band of rubber fastened between the rockers can be used for exercising the tibialis, extensor, peroneus and flexor longus muscles. With the foot positioned so the front portion of the foot is retained by the band of rubber the foot can be rocked to the inside and the outside, the leg can be twisted toward the inside of the step and with the heel of the foot resting on the bottom surface of the board the foot can be rocked back stretching the band of rubber.

Handles for picking up or grasping the exercise board are formed by holes which pass through the board adjacent the ends of the board formed by the convex arcs. A rubber strap is passed through one handle hole across both rockers and through the opposite handle hole, and exercises are performed using the strap by placing both feet on the board and, either while seated or standing, moving the arms and upper body against the resistance provided by the strap.

It is an object of the present invention to provide an exercise device for improving strength and mobility of the joints of the lower extremities.

It is another object of the present invention to provide a means mounted to the board for exercising the tibialis, extensor, peroneus and flexor longus muscles.

It is a further object of the present invention to provide an exercise device which can be used to perform exercises for the correction of posture.

Further objects, features and advantages of the invention will be apparent from the following detailed description when taken in conjunction with the accompanying drawings.

DESCRIPTION OF THE PREFERRED EMBODIMENTS

Figure 1:
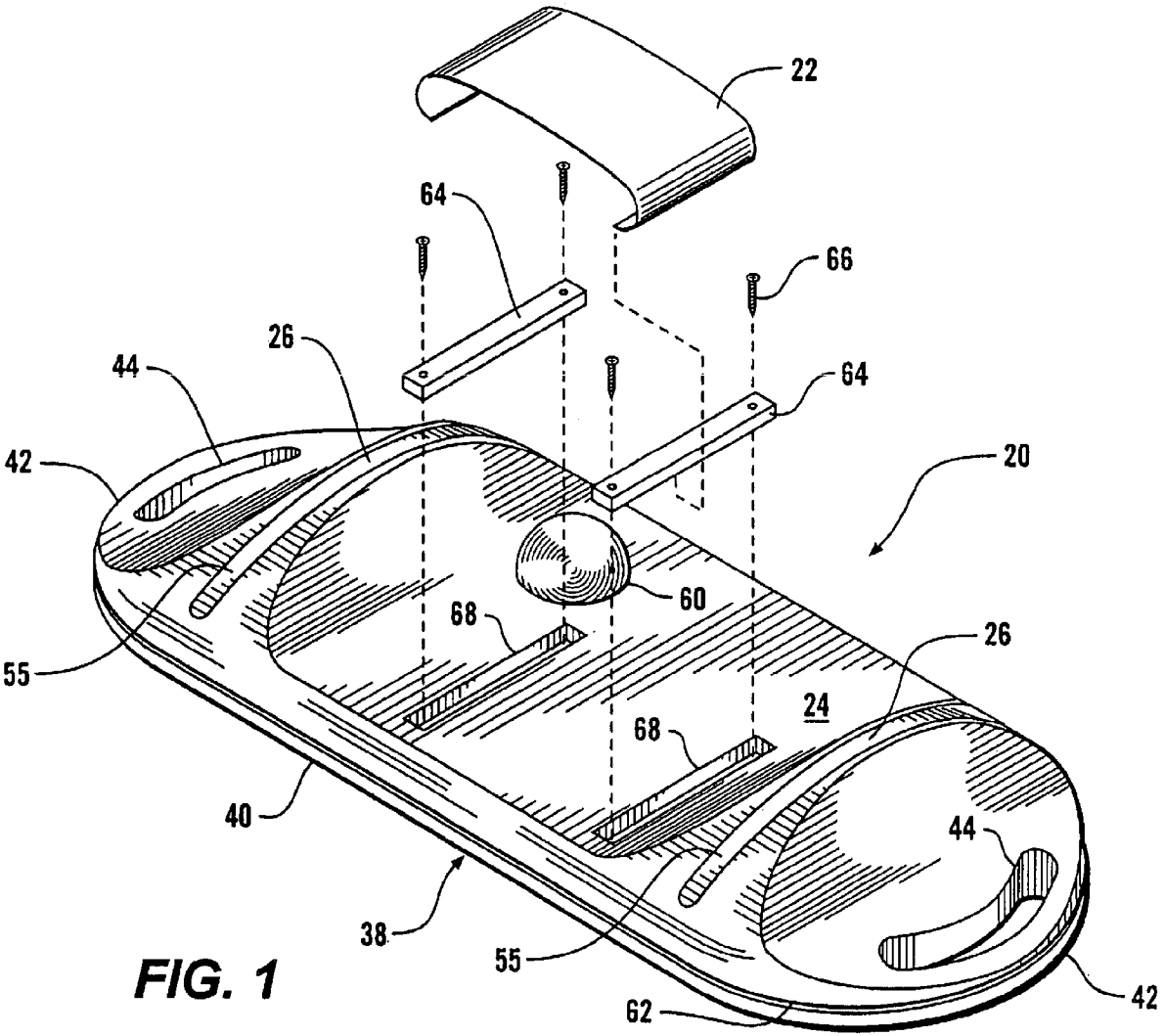
FIG. 1 is an exploded isometric view of the exercise board of this invention.
Figure 2:
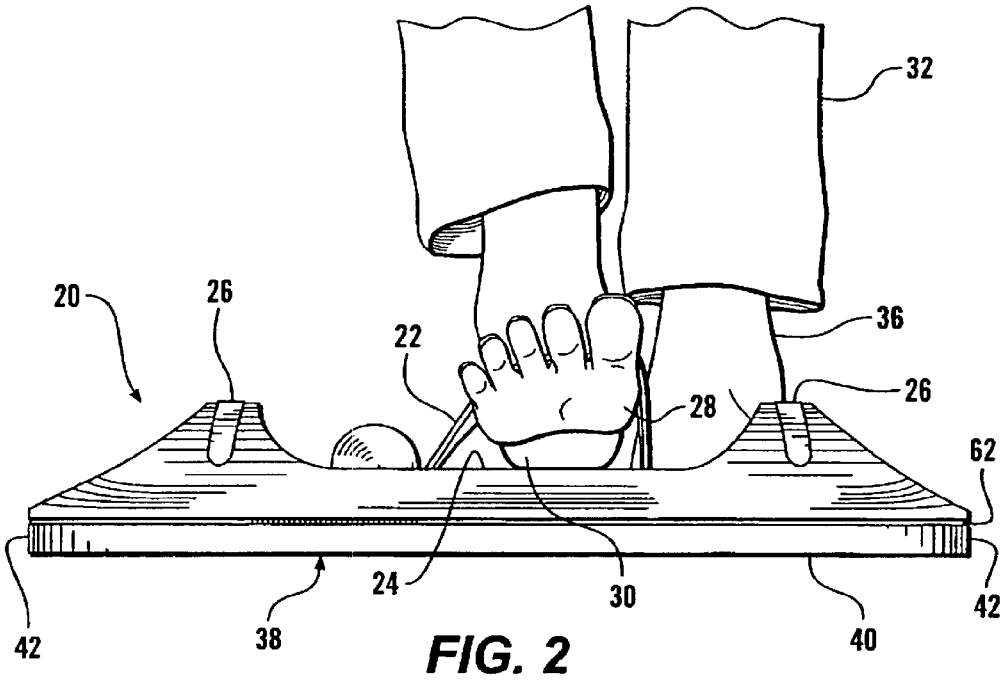
FIG. 2 is a front elevational view of the exercise board of FIG. 1 showing a first exercise.
Figure 3:
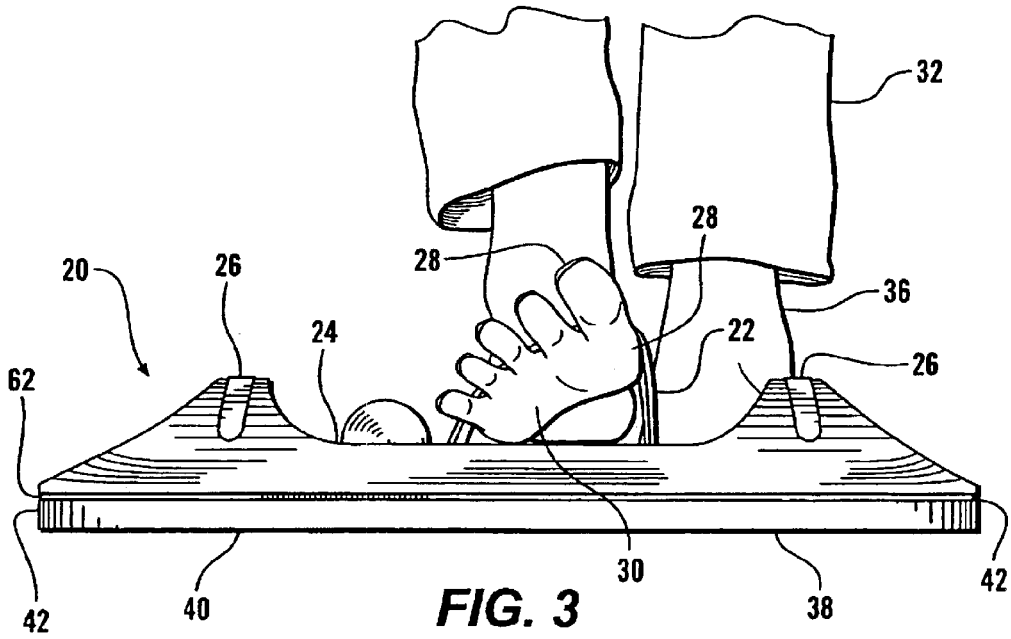
FIG. 3 is a front elevational view of the exercise board of FIG. 1 showing a second exercise.

Referring more particularly to FIGS. 1–9 wherein like numbers refer to similar parts, a rocker board 20 is shown in each of the figures. The board 20 is used to perform a wide variety of exercises which are particularly designed to increase the strength and flexibility of the lower body. The board is an improvement on my earlier invention shown in U.S. Pat. No. 5,643,164 which describes various exercises which can be performed using a board having features incorporated in the board 20. The improved board 20 incorporates a band of rubber 22 or other elastic material which is fastened to a bottom surface 24 between the board rockers 26. As shown in FIG. 2, the band of rubber 22 accommodates the front portion 28 of the foot 30 of a person 32 using the exercise board 20. The band or loop of rubber 22 is shown exploded away in FIG. 1, and in plan view in FIG. 7, and may be constructed of any elastic material, for example such as the Thera-Band® latex or latex free synthetic elastomer bands produced by the Hygienic Corporation.

Figure 4:
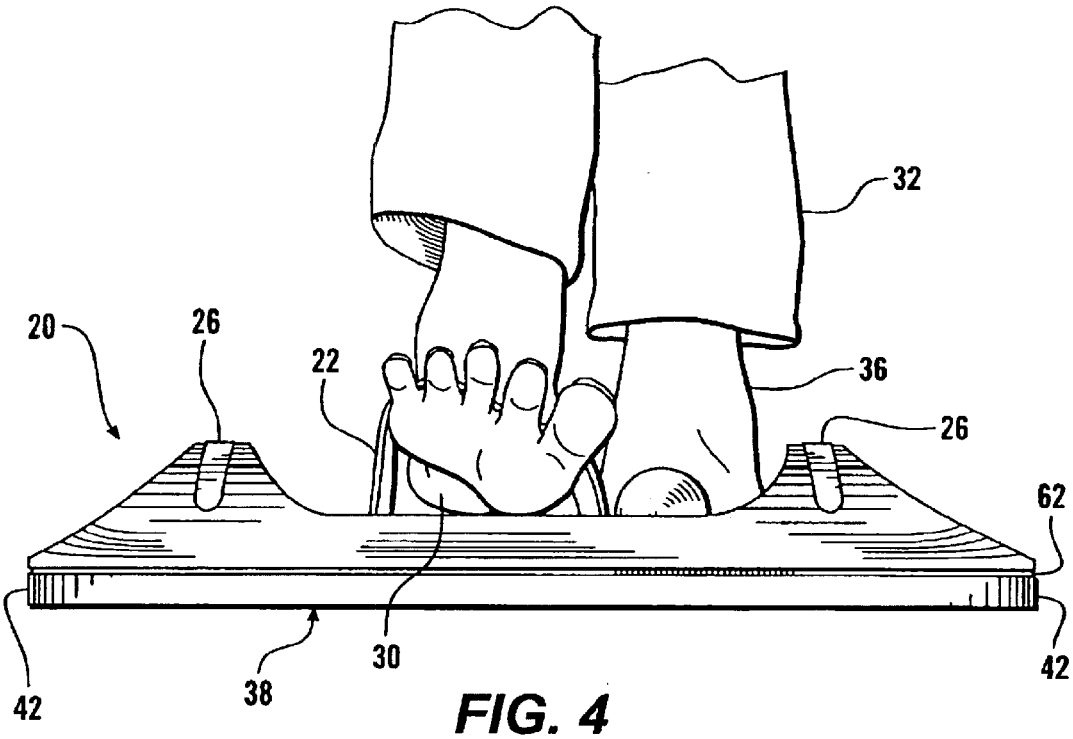
FIG. 4 is a rear elevational view of the exercise board of FIG. 1 showing a third exercise.

The band of rubber 22 biases the foot 30 placed within the band 22 into normal flat engagement with the bottom surface 24. Thus the muscles of the foot and lower leg may be exercised by moving the foot 30 against the elastic resistance provided by the band of rubber 22. As shown in FIG. 2, the foot 30 is rocked backwards so that the front portion 28 of the foot 30 engages and stretches the band of rubber 22. Thus the elastic resistance of the band of rubber 22 strengthens the tibialis and peroneus muscles. A second exercise, illustrated in FIG. 3, involves rotating the foot 30 to the outside which works the tibialis, extensor, and flexor hallicus longus muscles. A similar exercise is illustrated in FIG. 4 where the foot 30 is rotated to the inside of the step.

Figure 5:
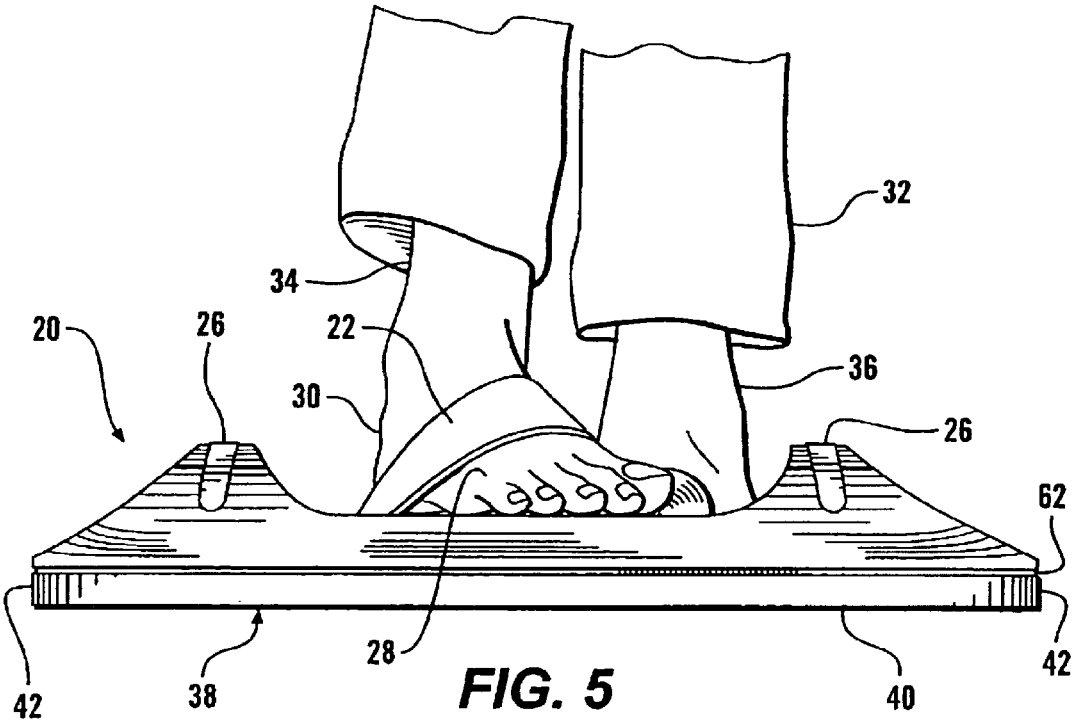
FIG. 5 is a rear elevational view of the exercise board of FIG. 1 showing a forth exercise.

FIG. 5 illustrates an exercise performed by rotating the whole leg 34 against resistance provided by the band of rubber 22. The foot 30 is slid the under the band 22 and the whole leg is rotated internally. During the foregoing exercises, if the board 20 has a tendency to move it can be held in place by the foot not being exercised 36. This exercise is designed to correct problems in persons who have excessive "flares" in one or both feet.

Figure 6:
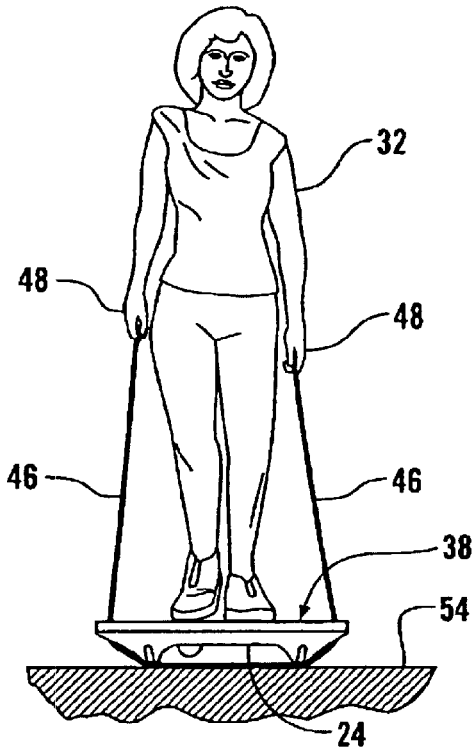
FIG. 6 is a front elevational view of the exercise board of FIG. 1 showing an exercise involving a rubber strap.
Figure 7:
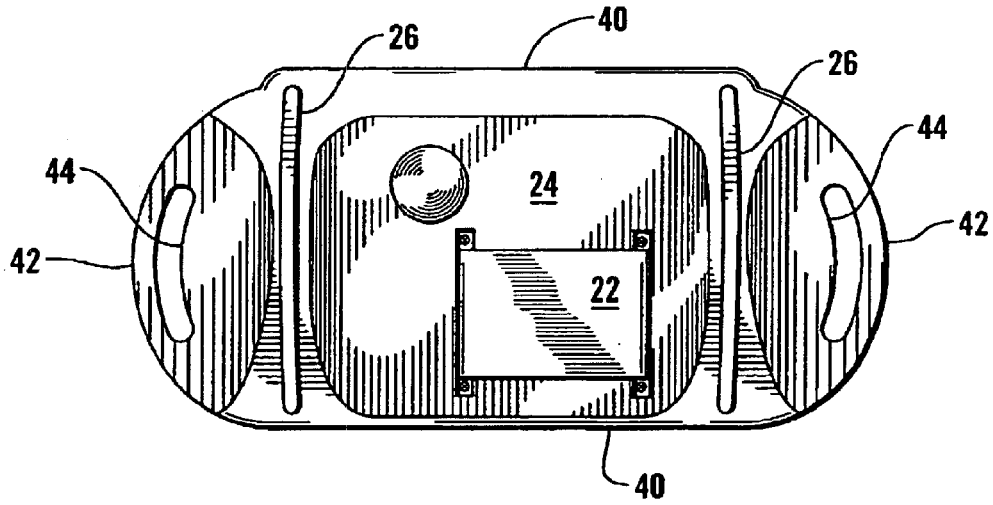
FIG. 7 is a bottom plan view of the exercise board of FIG. 1.
Figure 8:
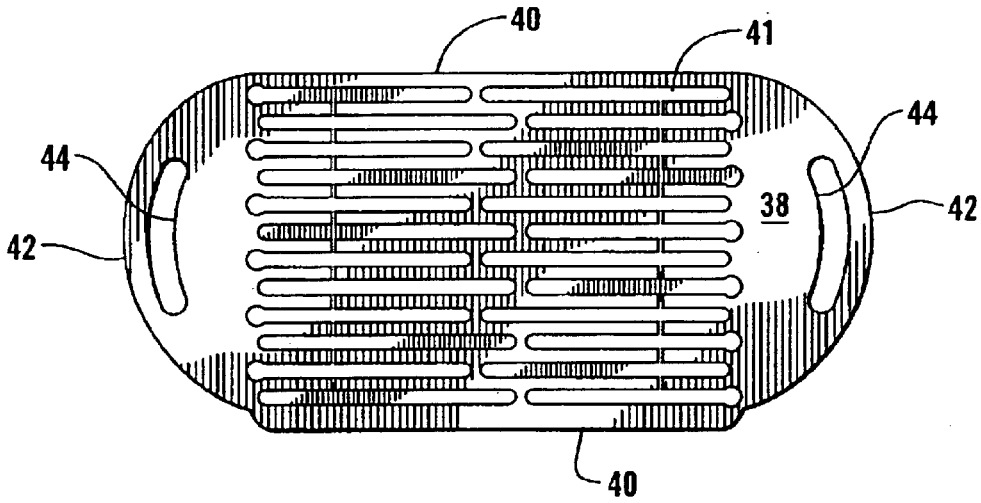
FIG. 8 is a top plan view of the exercise board of FIG. 1.

The upper surface 38 of the board 20 has a general rectangular shape with two long straight parallel sides or edges 40 connected to by two shorter convex arcs 42, as shown in FIG. 8, on which the person 32 who is exercising stands as shown in FIG. 6. Grip enhancing strips 41 are fixed to the upper surface 38. Spaced just inside of the convex arcs 42 are convex shaped holes 44 which form hand holds. The holes 44 can also be used to perform a set of exercises by running an elastic band or tube 46 such as the Thera-Band® latex tubing produced by the Hygienic Corporation. The elastic band 46 is threaded through one handhold 44, across both rockers 26, and up through the other handhold 44. The elastic band of 46 is grasped at each end with each hand 48 while standing on the board 20, or at least putting one foot on the board 20. The exercise is performed by raising one shoulder as high as possible, followed by lowering that shoulder and raising the opposite shoulder as high as possible as illustrated in FIG. 6. The exercise illustrated in FIG. 6 is designed to correct an imbalance of the shoulders.

A similar exercise (not illustrated) using the elastic band 46 is performed while sitting on a chair with both feet placed on the upper surface 38 of the board 20. The person exercising leans forward and grasps the rubber tubing 46. The exercise is performed in three distinct stages. The first movement is to raise the neck back as far as is comfortable, then the shoulders are pulled back, while still leaning over, squeezing the shoulder blades together. Finally the spine is extended or arched backwards. These exercises are designed to correct three posture conditions simultaneously: a forward head position where the head is not centered over the shoulders, rounded shoulders, and slumped posture.

Figure 9:
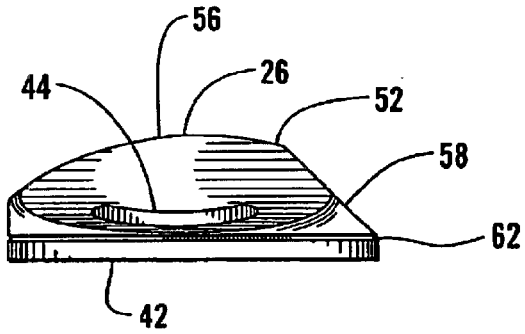
FIG. 9 is a side elevational view of the exercise board of FIG. 1.

The board 20 has certain similarities to my earlier invention shown in U.S. Pat. No. 5,643,164. Opposite the upper planer support surface 38 are the two spaced apart parallel arcuate rockers 26 which are perpendicular to the long sides 40 of the upper surface 38, the rockers extend outwardly of the bottom surface 24 of the board 20. Each rocker has a lower profile 52 as shown in FIG. 9 for engaging the floor 54, the lower profiles 52 of the two rockers 26 being substantially the same. The rockers 26 are covered with strips 55 of higher friction material as shown in FIG. 1. Each of the lower profiles 52 has an arcuate portion 56 which adjoins a straight portion 58. The arcuate portion 56 extends along more than half the lower profile 52 of the rockers 26. Each arcuate portion is part of a curved surface which gives the board 20 a rocking motion. The straight portions 58 define an angle of about 45 degrees to the upper surface 38, as shown in FIG. 9, so that when the exercise board is tilted to bring the straight portions 58 of the rocker profiles 52 into engagement with the floor 54, the upper surface is held in a static position at an angle of about 45 degrees to the floor. The straight portions 58 form part of a planer surface which intersects a plane formed by the upper surface 38 at about 45 degrees.

Similar to my earlier invention, a substantially hemispherical projection 60 extends from the lower surface 24 of the board 20. The hemispherical projection 60 is positioned spaced between the rockers 26 as shown in FIGS. 1–7. Sufficient space is provided between the rockers 26 for placing the foot 30 over the projection to stretch the foot without interference with the first and second rockers. The hemispherical projection 60 is offset laterally so as to be closer to one rocker 26, and horizontally to be closer to one of the long sides 40 to provide space for the band of rubber 22.

The board 20 can be manufactured by injection molding or rotational molding, but is preferably created as two injection molded pieces, of the material such as high impact polystyrene which are glued together along a parting line 62. The over-molding may be used to form the hemispherical projection 60 and the grip strips 41 on the upper surface 38 and the grip strips 55 on the rockers 26 of a softer material such as an elastic compound compatible form over-molding with polystyrene. Generally the hemispherical projection 60 may benefit from being formed of a different durometer from the gripping surfaces 41, 55. As shown in FIG. 1, the band of rubber 22 is held in place by a pair of cold rolled steel cleats 64 which are held by fasteners such as screws 66 into parallel pockets 68 recessed from the lower surface 24 of the board 20. The screws are received in brass inserts (not shown) which are inserted the lower surface 24 while the molded part is still hot. The edges of the rubber band 22 pass under the cleats, and the cleats 64 fit tightly so that the band of rubber 22 is clamped between the cleats 64 by the portion of the board forming the pockets 68.

In addition to the exercises shown in my earlier patent U.S. Pat. No. 5,643,164, and those described above, the following additional exercises have been developed for use with the exercise board 20 where the board is positioned with the straight portions 58 of the board rockers 26 flat against the floor 54 so that the upper surface 38 is positioned at an angle of 45 degrees with respect to the floor 54. The first exercise is performed with the heels of the feet on the floor and the front portion of the foot extending up the 45 degree slope formed between the board and the floor. The feet are spread slightly apart in the pigeon-toed position. The exercise is performed by squatting as if to sit just enough to feel stretching. The position is then held for 30 to 60 seconds. A second exercise is performed with the heels positioned on the floor and the front portions of the feet extending up the 45 degree angle while the pelvis is leaned to each side for 30 seconds. A third exercise is performed with the outside edge of a single foot placed partly on the floor and partly parallel to the long side 40. The body is leaned slightly toward the board 20 and the positioned held for 30 seconds to one minute. The fourth exercise is similar to the third exercise only the foot is flexed in the opposite direction. The exercise is performed while straddling the board 20 so the inside of the foot is placed on the edge of the board. A fifth exercise is performed by placing the toes and ball of the foot so that they extend upwardly along the slope surface of the board and stepping over the board with the other foot and bending the knee to obtain maximum stretch. This positioned is held for 30 seconds to one minute.

It should be understood that the band of rubber 22 may be a continuous loop which is attached to the underside of the board 20 or may be a strap of material as illustrated in FIG. 1. The band of rubber may be replaced with any elastic material which tends to bias the foot against the board, thus providing elastic resistance necessary for the various exercises performed using the band of rubber.

It is understood that the invention is not limited to the particular construction and arrangement of parts herein illustrated and described, but embraces all such modified forms thereof as come within the scope of the following claims.

I claim:

1. An exercise board for rocking on a floor comprising:

a board having an upper surface and a lower surface, the upper surface providing a place upon which a person may stand for performing an exercise;

a first rocker extending from the lower surface of the board perpendicular to the two long sides; and a second rocker extending from the lower surface of the board parallel to and spaced from the first rocker, wherein each rocker has a lower profile for engaging the floor, and wherein the lower profile of the first rocker is substantially the same as the lower profile of the second rocker, and wherein each of the lower profiles has an arcuate portion which adjoins a straight portion, wherein the arcuate portion extends along more than half the lower profile of the rocker, and wherein the straight portion defines an angle of about 45 degrees to the upper surface, so that when the exercise board is tilted to bring the straight portions of the rocker profiles into engagement with the floor the upper surface is held in a static position at an angle of about 45 degrees to the floor;

a substantially hemispherical projection which extends from the lower surface of the board which is spaced between the first rocker and the second rocker and wherein there is sufficient space around the projection for placing a foot over the projection to stretch the foot without interference with the first and second rockers; and an elastic loop spaced between the first rocker and the second rocker, wherein the elastic loop is of sufficient size to accept a front portion of a foot.

2. The exercise board of claim 1 further comprising:

portions of the board defining two parallel pockets formed recessed from the lower surface of the board; and two cleats received within the pockets and fastened therein to the board, wherein the band of rubber passes beneath the cleats and is clamped between the cleats and the board.

3. An exercise board for use on a floor, the board for increasing the range of motion of the lower extremities and the lumbar-pelvic spine, the board comprising:

a means for engaging both feet of a standing person; and a first and second smoothly curved means for providing a rocking motion in a single plane mounted to the means for engaging; and a first and second means for supporting feet of a standing person at a fixed angle of about 45 degrees with respect to a floor, which adjoins the means for providing a rocking support, a substantially hemispherical projection which is fixed beneath the means for engaging and is spaced between the first and second smoothly curved means for providing a rocking motion and wherein there is sufficient space around the projection for placing a foot over the projection to stretch the foot without interference from the first and second smoothly curved means; and a means for exercising portions of a lower limb by elastically biasing the portion of the lower limb against the exercise board, the means for exercising portions of the lower limb spaced between the first and second smoothly curved means.

4. An exercise board for rocking on a floor comprising;

a board having an upper surface which is suitable for standing on, and at least one straight edge;

at least one portion of a curved surface mounted to the board opposite the upper surface, engageable with the floor to give the board a rocking motion;

at least one portion of a planar surface mounted to the board opposite the upper surface, the planar surface intersecting a plane defined by the upper surface parallel to the at least one straight edge so that when the at least one portion of the planar surface is held against the floor the board upper surface is held at an angle of approximately 45 degrees to the floor; and an elastic band mounted to the board opposite the upper surface, the elastic band forming a loop which accommodates the front portion of a foot of a person to bias the foot against the board.

5. The exercise board of claim 4 further comprising a substantially hemispherical projection which extends from the board opposite the upper surface wherein there is sufficient space around the projection for placing a foot over the projection to stretch the foot without interference.

6. The exercise board of claim 5 further comprising two spaced apart rockers, each rocker forming a portion of the curved surface, and each rocker forming a portion of the planar surface, and wherein the elastic band is mounted between the spaced apart rockers.

* * * * *